US008596667B1

(12) United States Patent
Colaianni

(10) Patent No.: US 8,596,667 B1
(45) Date of Patent: Dec. 3, 2013

(54) SKI WITH SIDE WALL CUTOUTS

(76) Inventor: Michael Colaianni, Ho-Ho-Kus, NJ (US)

( * ) Notice: Subject to any disclaimer, the term of this patent is extended or adjusted under 35 U.S.C. 154(b) by 0 days.

(21) Appl. No.: 13/233,281

(22) Filed: Sep. 15, 2011

Related U.S. Application Data

(60) Provisional application No. 61/467,193, filed on Mar. 24, 2011.

(51) Int. Cl.
*A63C 5/04* (2006.01)

(52) U.S. Cl.
USPC ..... 280/609

(58) Field of Classification Search
USPC ..... 280/608, 609, 11.19, 14.1, 614–623; 441/65–66; D21/760–761, 765–766, D21/801, 803; D12/6
See application file for complete search history.

(56) References Cited

U.S. PATENT DOCUMENTS

| | | | | |
|---|---|---|---|---|
| 1,545,013 | A * | 7/1925 | Riebe | 280/600 |
| D607,523 | S * | 1/2010 | Chables Sandoval et al. | D21/769 |
| 2004/0046362 | A1* | 3/2004 | Restani | 280/602 |
| 2008/0238040 | A1* | 10/2008 | Avgustin et al. | 280/601 |
| 2010/0194076 | A1* | 8/2010 | Wilson | 280/609 |

* cited by examiner

*Primary Examiner* — John Walters
*Assistant Examiner* — James Triggs
(74) *Attorney, Agent, or Firm* — Michael J. Feigin, Esq.; Feigin & Associates, LLC

(57) ABSTRACT

The disclosed technology allows for easier turning and a lighter ski by providing cut-out portions, cut into the side of a ski at one or both tips. These cut-out portions jut inward from the side creating a jagged, keyed, or honeycomb configuration with at least one slit, slot, triangle, or regular polygon, cut into the side of the ski, such as in a mirror image on each side of a tip, and/or correspondingly on each tip. In deep powder snow, the powder may rise through the cut-outs, allowing for less friction (smaller surface area) and path for the snow to flow, allowing the ski to turn more easily. In addition, the cut out portions reduce the weight of the ski relative to a conventional ski, and may provide a more aerodynamic design.

12 Claims, 12 Drawing Sheets

SKI WITH SIDE WALL CUTOUTS

This application claims priority to U.S. patent application No. 61/467,193, filed on Mar. 24, 2011.

FIELD OF THE DISCLOSED TECHNOLOGY

The disclosed technology relates generally to skis and more particularly to a ski design.

BACKGROUND OF THE DISCLOSED TECHNOLOGY

Skiing is a popular and challenging sport that has fostered numerous equipment modifications by active enthusiasts. Designers have attempted many different designs using various ski shape configurations and materials. Nevertheless, the search for a more perfect ski, or at least, a ski that will perform better in certain snow conditions, continues.

One challenge faced by skiers is the problem of turning quickly. This can be true particularly in certain types of snow, such as deep powder snow. Thus, there continues to be a need for a ski that can perform well in such conditions.

Furthermore, skiers are constantly trying to create unique visual displays on their skis to give the skis a unique appearance. Traditionally, this involves unique paint patterns or designs that are adhered to the surface of the ski. However, the search for a distinctive identifier will continue to exist among both skiers and ski manufacturers.

SUMMARY OF THE DISCLOSED TECHNOLOGY

An object of the disclosed technology is to provide a ski, which turns more easily (requires less force) than current skis known in the art.

Another object of the disclosed technology is to provide a ski with a distinctive design.

Yet, another object of the disclosed technology is to reduce the weight of a ski.

In an embodiment of the disclosed technology, a ski with a top side, two sides, and bottom side has a central region adapted for receiving a binding on the top side thereof and has a planar surface. Tip areas are at either end of the central region, defined by an upward arc relative to the planar surface of the top side of the central region. At least one square cut-out is on each side of the at least one said tip area. The square cut-outs, alternatively, may be on each tip, and there may be three square cut-outs on each side of each tip. The squares may be of equal area, and may be at least three inches long.

In another embodiment, a tip may have a rounded or pointed end, generally parallel side walls extending away from the tip, mirrored cut-outs on either side of the generally parallel side walls extending inward from the side walls towards each other, and a planar surface on a tip and bottom side of the tip, between the cut-outs. The mirrored cut-outs may be rectangular, square, triangular (isosceles or equilateral), or a regular polygon, such as a pentagon or hexagon, which may be arranged in honeycomb fashion, defined as a row of at least three regular polygons on each side of the ski tip.

A ski in an embodiment of the disclosed technology may include the following: a top side with binding, a bottom side adapted for contact with snow during skiing, side walls extending around a perimeter of the ski between the top side and the bottom side and joining at a front tip and back tip. The side walls jut inward in an identical manner at either side of the front tip, and in some embodiments, also at the back tip, such as at regular intervals of three such inward juttings on each side, which may be in the shape of a rectangle. The sides may be reinforced with additional structural supporting material at the juttings and are adapted for flow of snow therethrough when used for skiing.

The side walls of the tips are spaced further apart than the side walls at a center region of said ski, in an embodiment thereof, and the space between two said identical juttings closest to the tips of the ski may be less than the space between side walls at and along the center region of the ski.

DETAILED DESCRIPTION OF EMBODIMENTS OF THE DISCLOSED TECHNOLOGY

The disclosed technology allows for easier turning and a lighter ski by providing cut-out portions, cut into the side of a ski at one or both tips. These cut-out portions jut inward from the side, creating a jagged, keyed, or honeycomb configuration with at least one slit, slot, triangle, or regular polygon, cut into the side of the ski, such as in a mirrored image on each side of a tip, and/or correspondingly on each tip. In deep powder snow, the powder may rise through the cut-outs allowing for less friction (smaller surface area) and path for the snow to flow, allowing the ski to turn more easily. In addition, the cut out portions reduce the weight of the ski relative to a conventional ski, and may provide a more aerodynamic design.

Embodiments of the disclosed technology will become clearer in view of the following description of the figures.

Figure 1:
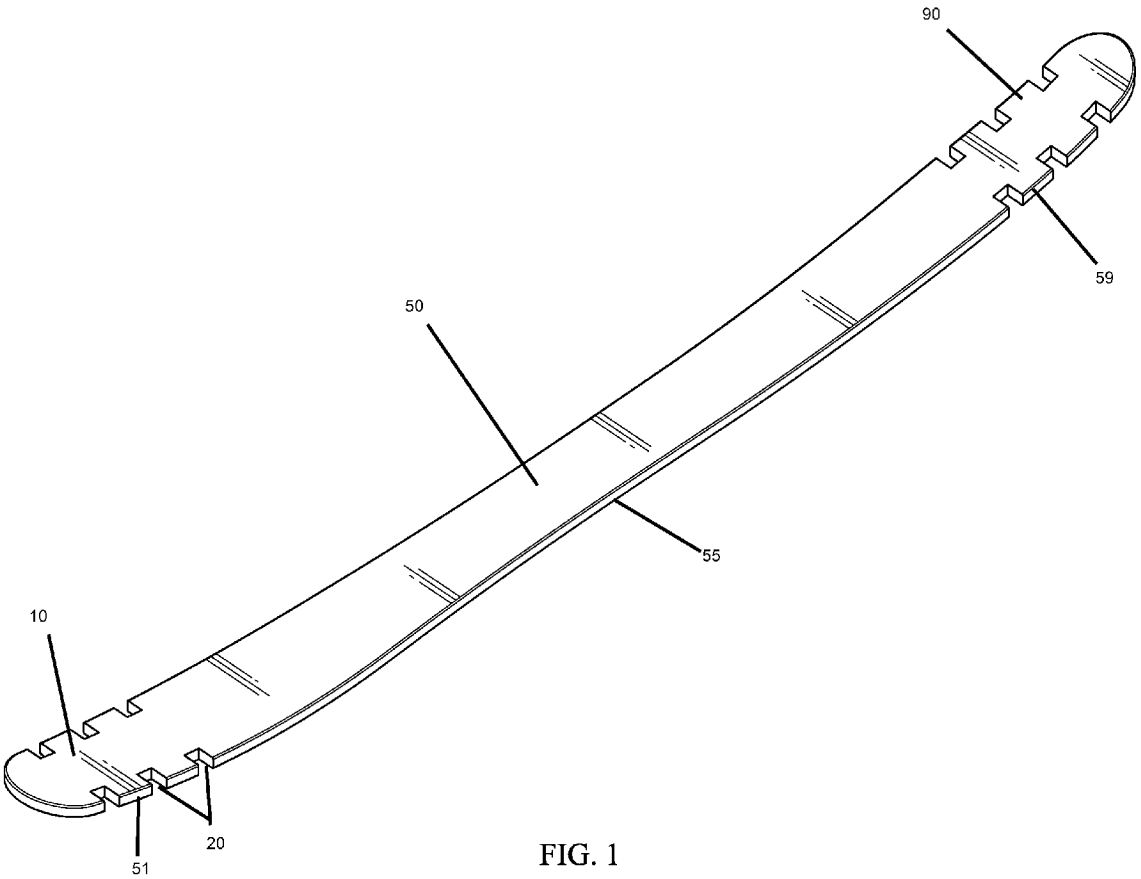
FIG. 1 shows a top perspective view of a ski of embodiments of the disclosed technology.

FIG. 1 shows a top perspective view of a ski of embodiments of the disclosed technology. The cut-out portions 20 are roughly 1 inch square in this view. For the front tip 10 of the ski in this embodiment, the 1 inch cut-out portions begin approximately 2½ inches from the front of the ski. The cut-out portions on each side are separated by 2 inch portions of the full ski edge before the cut-outs are repeated two more times. In this embodiment, three cut-outs are utilized in the front tip of the ski on one side, and another three cut-outs are similarly placed on the opposing side. In FIG. 1, the rear tip cut-outs begin approximately 2½ inches from the rear of the ski and are 1 inch cut-outs. Three cut-outs are utilized in the embodiment in FIG. 1 on both sides of the rear tip. The depth of the cut-out(s) toward the center longitudinal axis of the ski may vary. In accordance with one embodiment, the predetermined depth may be ⅛ inch, ¼ inch, ½ inch, 1 inch, 2 inches, or 3 inches.

The cut-outs 20 are cut into the sides 51 of the front tip 10, and the sides 59 of the rear tip 90. A central region with top side 50 and sides 55, where a binding for attachment to a boot or placement of a foot, as is known in the art, is situated between the tip regions 10 and 90. The center or central region 50/55 ends where the ski starts to point upward from the ground at the tip regions 10 and 90. In another embodiment/definition thereof, the central region 50/55 ends when the top 50 and sides 55 are beginning to angle and are no longer planar (defined as relatively flat, according to an average use thereof when comparing the central portion to the tip portions). The cut-outs 20 jut inwards from the side walls of one or both tip side walls 51 and 59 and may be reinforced with additional ribbing or support structures to ensure strength.

Figure 2:
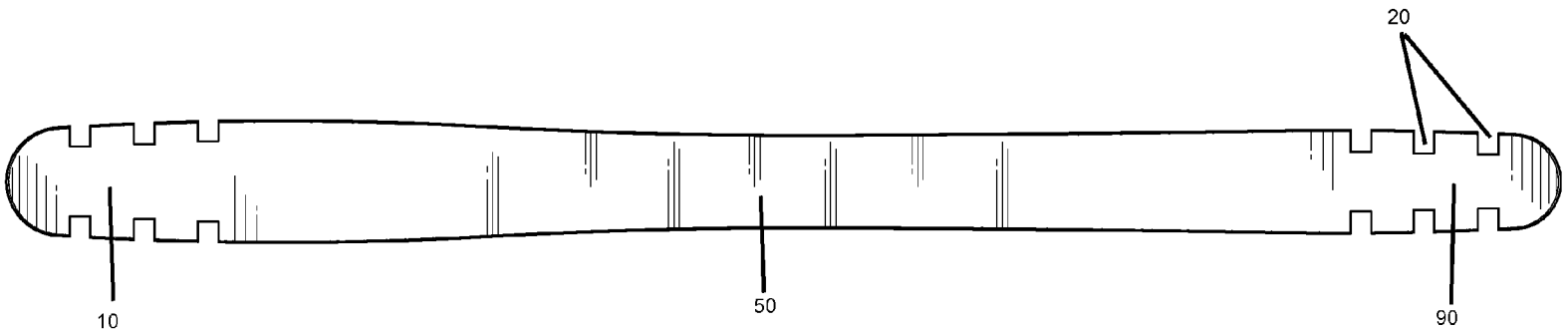
FIG. 2 shows a top plan view of a ski of embodiments of the disclosed technology.

FIG. 2 shows a top plan view of a ski of embodiments of the disclosed technology. This ski has a wider front tip region 10 than the central region 50 at the top side, and rounded front (a pointed front, as known in the art, may also be used). Note that the juttings 20 (only some of which are labeled for clearer viewing) extend inward, such that the width of the top portion between the juttings 20 is less than the width at a central region 50 of the ski, despite the fact that the width of the ski tip itself is greater than the central region.

Figure 3:
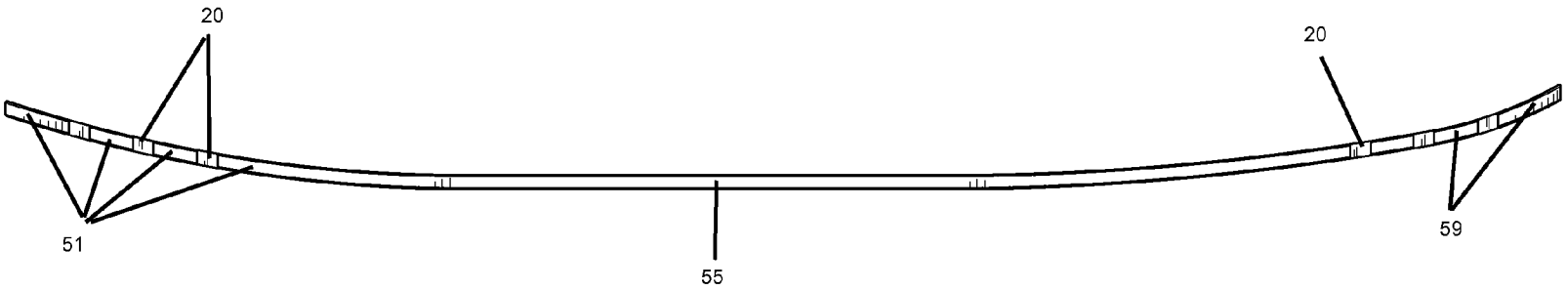
FIG. 3 shows a side view of a ski of embodiments of the disclosed technology.

FIG. 3 shows a side view of a ski of embodiments of the disclosed technology. The tip regions with side walls 51/59 angle upward from the generally flat side walls 55 of the central region and have three equally spaced juttings or cut-outs 20 on each tip. When viewing with FIG. 2, it may be seen that the cut-outs 20 are mirrored from one side of the ski to the other, as well as from one tip to the other. Either of these mirrorings is within the scope of the disclosed technology. For purposes of this disclosure, "generally" is defined as "to an ordinary observer". That is, "generally flat" or "generally perpendicular" is defined as what an ordinary observer viewing the object at a distance would call "flat" or "perpendicular", respectively.

Figure 4:
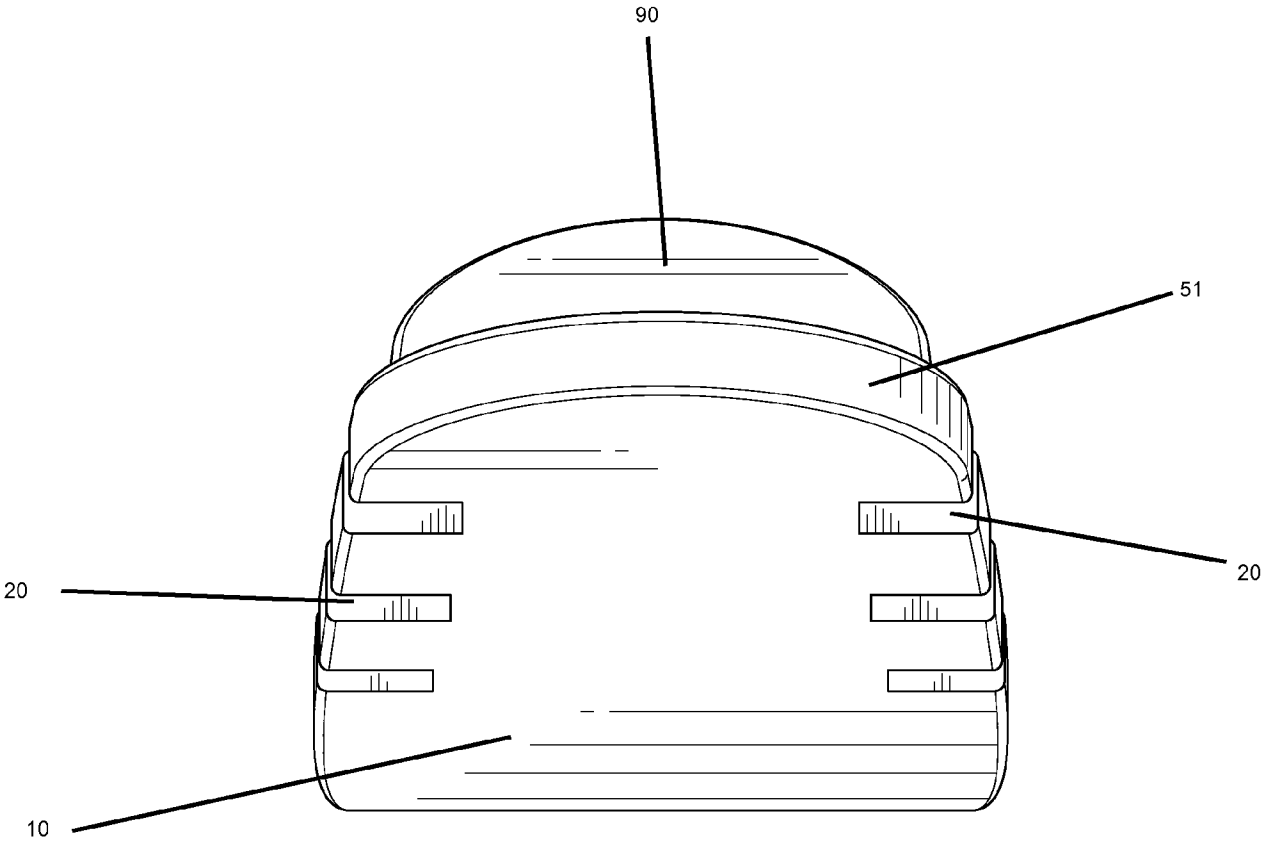
FIG. 4 shows a side view directed at a tip of a ski of embodiments of the disclosed technology.

FIG. 4 shows a side view directed at a tip of a ski of embodiments of the disclosed technology. The rectangular cut-outs 20 may be seen on tip 10. A rounded side wall 51 is shown going around the side of the ski, including the end, and the other tip region 90 is seen in the background.

Figure 5:
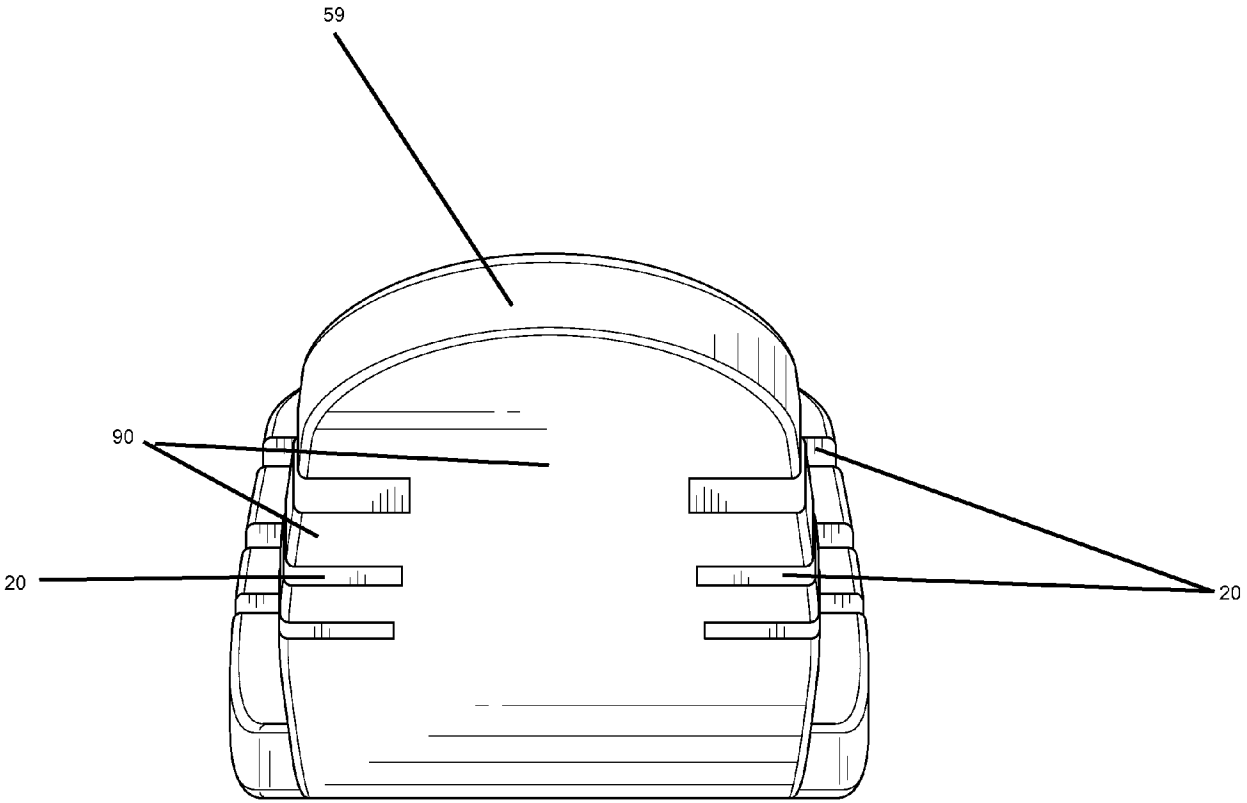
FIG. 5 shows a side view directed at an opposite tip of a ski of embodiments of the disclosed technology.

FIG. 5 shows a side view directed at an opposite tip of a ski in embodiments of the disclosed technology. This figure is analogous to that of FIG. 4, but from a 180 degree perspective, showing side wall 59 and tip region 90 in the foreground, with tip region 10 in the background.

Figure 6:
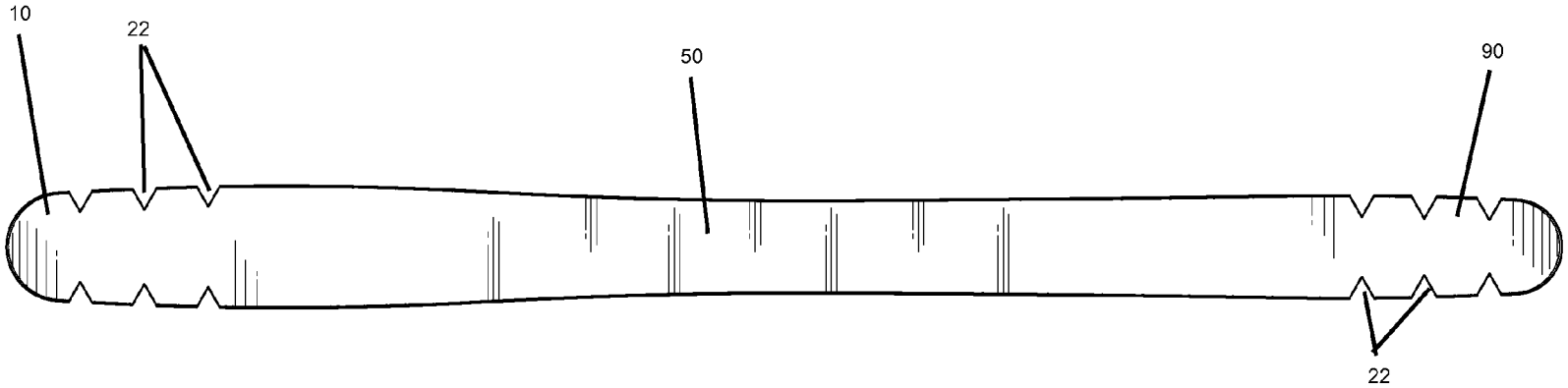
FIG. 6 shows a plan view of a ski with equilateral triangular cut-outs of embodiments of the disclosed technology.

FIG. 6 shows a plan view of a ski with equilateral triangular cut-outs of embodiments of the disclosed technology. The equilateral triangular cut-outs 22 are shown in this figure.

Figure 7:
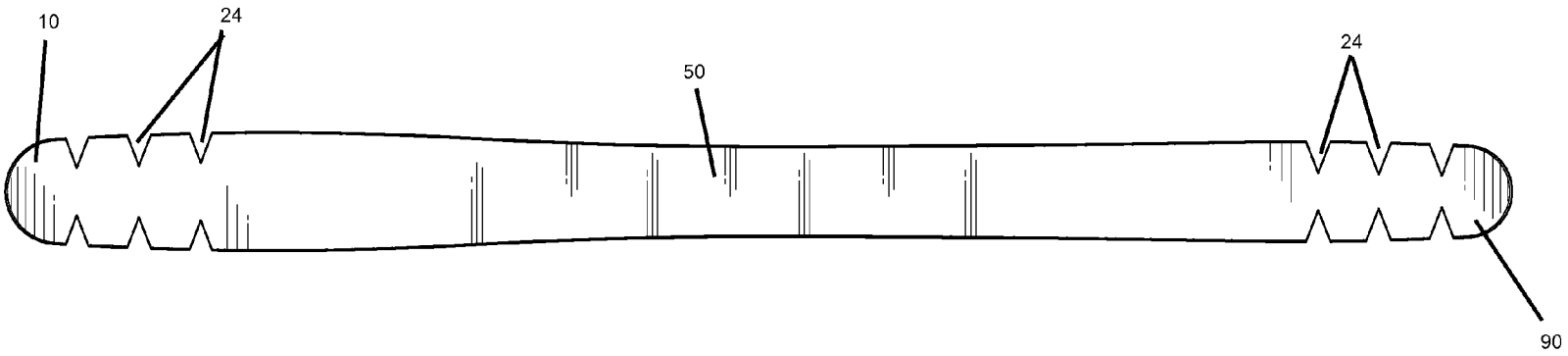
FIG. 7 shows a plan view of a ski with isosceles triangular cut-outs of embodiments of the disclosed technology.

FIG. 7 shows a plan view of a ski with isosceles triangular cut-outs of embodiments of the disclosed technology. Here, the isosceles triangles 24 extend inward from the edges.

Figure 8:
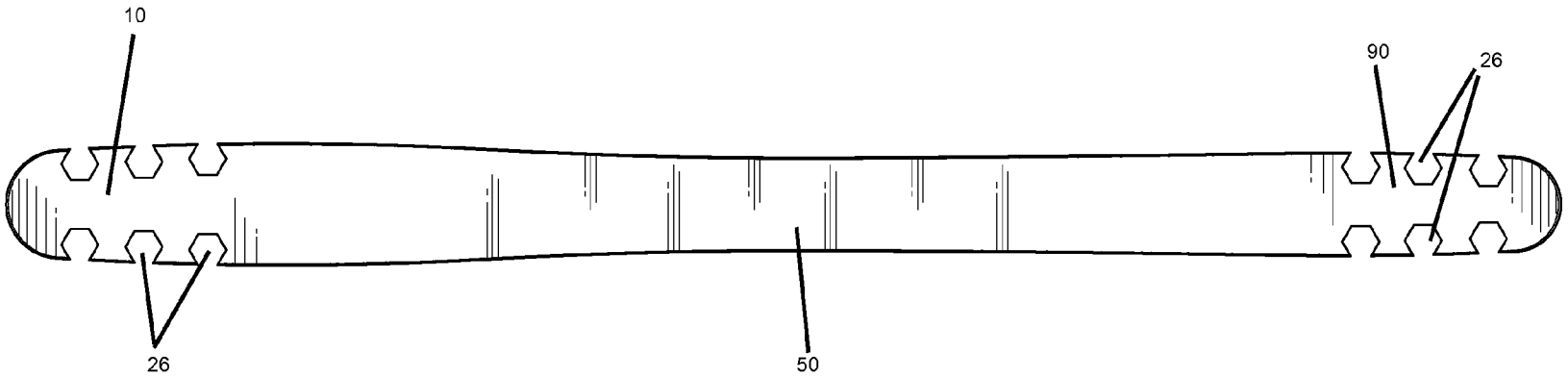
FIG. 8 shows a plan view of a ski with pentagon cut-outs of embodiments of the disclosed technology.

FIG. 8 shows a plan view of a ski with pentagon cut-outs of embodiments of the disclosed technology. Here, the cut-outs are hexagon-shaped 26 with the full hexagon cut into the side wall (the fifth side being formed by an imaginary line extending from the extremity of the side wall, as if the cutout did not exist, such as being an extension of the side walls of the ski, if not cut out). The arrangement of three polygonal shapes with five sides or more in a row is defined as honeycomb, for purposes of this disclosure.

Figure 9:
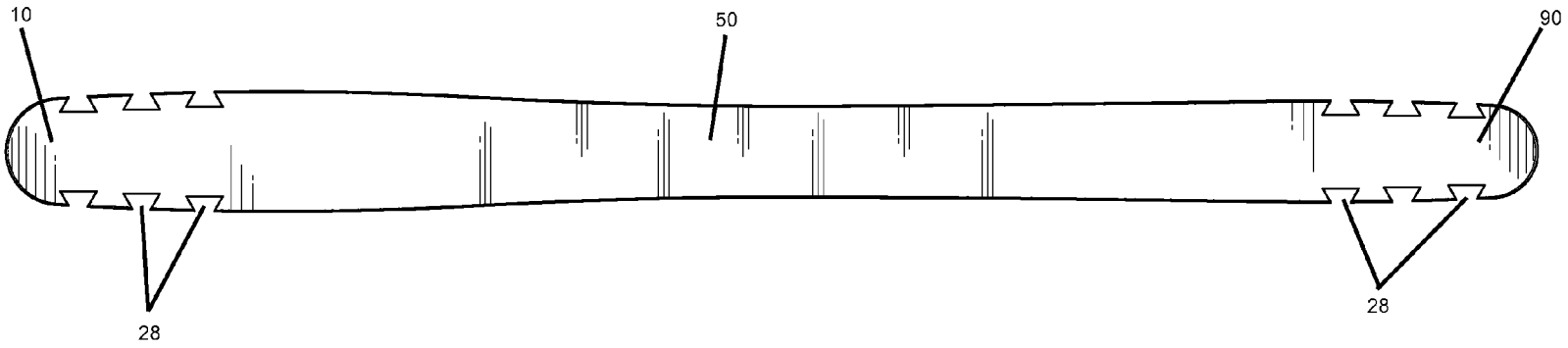
FIG. 9 shows a plan view of a ski with partial triangular cut-outs of embodiments of the disclosed technology.

FIG. 9 shows a plan view of a ski with partial triangular cut-outs of embodiments of the disclosed technology. The partial triangle 28 has an imaginary portion of the triangle extending out from the side plane of the ski.

Figure 10:
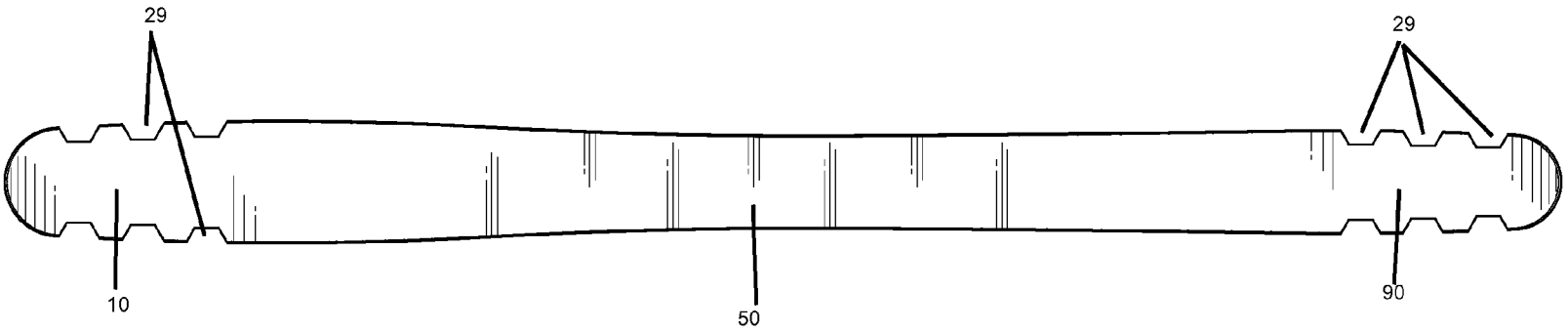
FIG. 10 shows a plan view of a ski with partial hexagon cut-outs of embodiments of the disclosed technology.

FIG. 10 shows a plan view of a ski with partial hexagon cut-outs of embodiments of the disclosed technology. Like the partial triangle cut-out of FIG. 9, the partial hexagon cut-out 29 has a portion within the plane of the side of the ski, and a portion extending imaginarily outside the plane.

Figure 11:
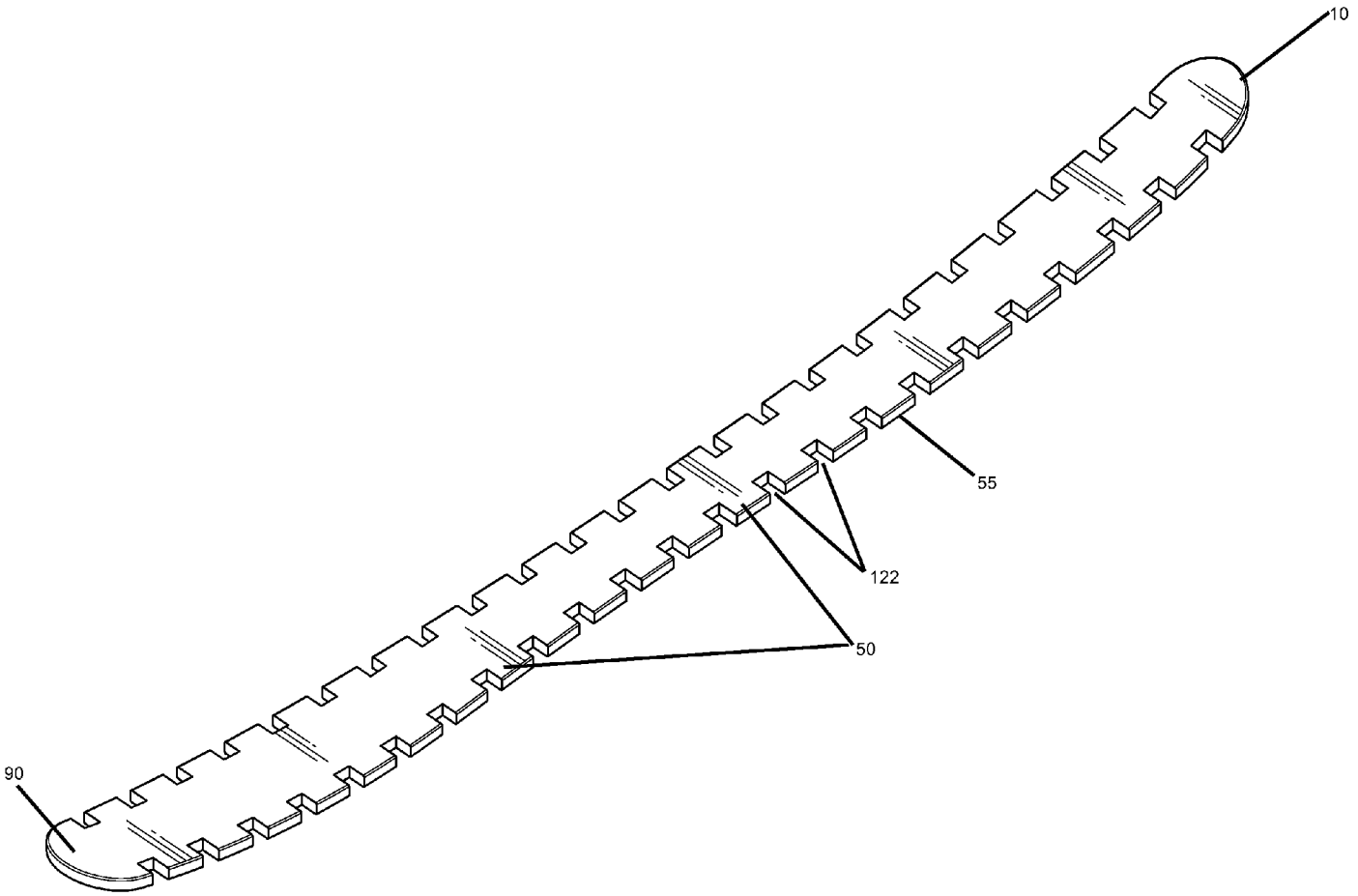
FIG. 11 shows a perspective view of alternate embodiment with cut-outs on an entire side of a ski in an alternative embodiment of the disclosed technology.

FIG. 11 shows a perspective view of alternate embodiment with cut-outs on an entire side of a ski in an alternative embodiment of the disclosed technology. The ski, with end regions 10 and 90 and mid region 50 is similar to those of the prior embodiments. However, the ski of FIG. 11 has rectangular cut-outs or slits 122 extending all the along each side of a ski 55. In embodiments of the disclosed technology, any of the cut-outs 22, 24, 26, 28, or 29 as shown in prior Figures may be cut-out along an entire side, as shown with respect to FIG. 11. The cut-outs 122 may each be the same size, or a larger cutout may be used near or at the tip regions 10/90 than the central region 50 the flat bottomed portion of the ski).

Figure 12:
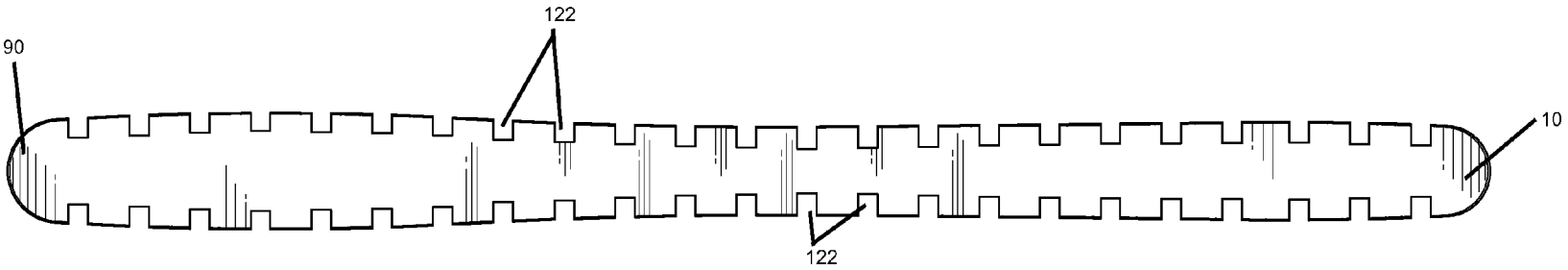
FIG. 12 shows a plan view of the ski of FIG. 11.

FIG. 12 shows a plan view of the ski of FIG. 11. The cut-outs 122 on either side are mirror images on each side, as shown. In this manner, powdered or other snow may press through the cut-outs allowing for easier turning and a lighter ski. The cut-outs shown extend along an entire length of the side walls 55 of the ski. For purposes of this disclosure, an "entire length" is defined as from near the end of a tip region, and tip to near the end of the other tip region, and tip which must be less than 6 inches from the tip. In another embodiment, the cut-outs extend around the tip in a continuous fashion.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods, systems, and devices described herein-above are also contemplated and within the scope of the disclosed technology.

I claim:

1. A ski with a top side, two sides, and bottom side, comprising:

a central region adapted for receiving a binding on said top side thereof and having a planar surface;

tip areas at either end of said central region, defined by an upward arc relative to said planar surface of said top side of said central region; and at least one square cutout on each of said sides of at least one said tip area, wherein said at least one square cut-out is three square cutouts.

2. The ski of claim 1, wherein said at least one tip is two tip areas.

3. The ski of claim 1, wherein all said square cut-outs are of equal area.

4. The ski of claim 3, wherein each said square cut-out cuts into a said side of said ski at least 3 inches.

5. A tip comprising:

a rounded or pointed end;

generally parallel side walls extending away from said tip;

mirrored cutouts on either side of said generally parallel side walls extending inward from said side walls towards each other; and a planar surface on a tip and bottom side of said tip, between said cut-outs, wherein said mirrored cut-outs are rectangular; and wherein said said mirrored cutouts extend along an entire length of said generally parallel side walls.

6. The ski tip of claim 5 wherein said mirrored rectangular cutouts are square.

7. A tip comprising:

a rounded or pointed end;

generally parallel side walls extending away from said tip;

mirrored cutouts on either side of said generally parallel side walls extending inward from said side walls towards each other; and a planar surface on a tip and bottom side of said tip, between said cut-outs, wherein said said mirrored cut-outs extend along an entire length of said generally parallel side walls.

8. A tip comprising:

a rounded or pointed end;

generally parallel side walls extending away from said tip;

mirrored cutouts on either side of said generally parallel side walls extending inward from said side walls towards each other; and a planar surface on a tip and bottom side of said tip, between said cut-outs, wherein said mirrored cut-outs are in the shape of a regular polygon.

9. The ski tip of claim 8, wherein said mirrored cut-outs are arranged in honeycomb fashion with a row of at least three said regular polygons on each side of said ski tip.

10. The ski of claim 9, wherein said juttings extend along said side walls from a front region to a back region through and including a central region; wherein said front and said back region are defined by an upwards curvature of the ski and said central region is a flat bottomed region between said front and said back region.

11. A ski, comprising:

a top side with binding;

a bottom side adapted for contact with snow during skiing;

side walls extending around a perimeter of said ski between said top side and said bottom side and joining at a front tip and back tip;

wherein said side walls jut inwards in an identical manner at either side of said front tip, and wherein said side walls of said tips are spaced further apart than said side walls at a center region of said ski.

12. A ski, comprising:

a top side with binding;

a bottom side adapted for contact with snow during skiing;

side walls extending around a perimeter of said ski between said top side and said bottom side and joining at a front tip and back tip;

wherein said side walls jut inwards in an identical manner at either side of said front tip, and wherein said space between two said identical juttings closest to said tips of said ski is less than the space between said side walls at said center region of said ski.

* * * * *